US007641433B2

(12) United States Patent
Trovinger

(10) Patent No.: US 7,641,433 B2
(45) Date of Patent: Jan. 5, 2010

(54) SYSTEM AND METHOD OF TRIMMING A BOUND DOCUMENT

(75) Inventor: Steven W. Trovinger, Los Altos, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 572 days.

(21) Appl. No.: 11/287,539

(22) Filed: Nov. 23, 2005

(65) Prior Publication Data

US 2007/0116542 A1 May 24, 2007

(51) Int. Cl.

| | |
|---|---|
| ***B42C 13/00*** | (2006.01) |
| ***B42C 11/00*** | (2006.01) |
| ***B42C 5/00*** | (2006.01) |
| ***B42B 9/00*** | (2006.01) |

(52) U.S. Cl. ..... 412/16; 412/14; 412/18; 412/25; 412/32

(58) Field of Classification Search ..... 270/4, 270/5.02, 6, 16, 20.1, 21.1, 39.01, 41, 52.17; 412/1, 3, 9, 11, 13, 16, 17, 18, 19, 21, 32
See application file for complete search history.

(56) References Cited

U.S. PATENT DOCUMENTS

| | | | | |
|---|---|---|---|---|
| 6,099,225 | A | 8/2000 | Allen et al. | |
| 6,632,061 | B2 * | 10/2003 | Trovinger | 412/11 |
| 6,708,967 | B1 | 3/2004 | Trovinger et al. | |
| 6,834,853 | B2 | 12/2004 | Trovinger et al. | |
| 2002/0168247 | A1 | 11/2002 | Trovinger et al. | |
| 2003/0107164 | A1 * | 6/2003 | Todie | 270/5.02 |
| 2004/0041326 | A1 | 3/2004 | Trovinger | |
| 2004/0089999 | A1 * | 5/2004 | Trovinger et al. | 271/207 |
| 2004/0094884 | A1 | 5/2004 | Trovinger et al. | |
| 2004/0094891 | A1 | 5/2004 | Trovinger et al. | |
| 2004/0154485 | A1 * | 8/2004 | Boss | 101/226 |
| 2004/0175255 | A1 | 9/2004 | Trovinger et al. | |
| 2004/0188910 | A1 | 9/2004 | Trovinger et al. | |
| 2004/0239027 | A1 | 12/2004 | Trovinger et al. | |
| 2005/0011322 | A1 | 1/2005 | Trovinger | |
| 2005/0056986 | A9 | 3/2005 | Trovinger et al. | |

FOREIGN PATENT DOCUMENTS

| | | |
|---|---|---|
| EP | 0 992 365 A1 | 4/2000 |
| WO | WO 00/18583 | 6/2000 |

* cited by examiner

*Primary Examiner*—Dana Ross
*Assistant Examiner*—Justin V Lewis

(57) ABSTRACT

A method of trimming a plurality of sheets bound together, in which each of the plurality of sheets defines a first edge and a second edge opposite the first edge that collectively define a fore edge of the closed bound document, comprising selecting a first portion of the plurality of sheets, folding the first portion of the plurality of sheets at a first fold angle and in a first fold direction, and trimming the folded first portion of the plurality of sheets near the first portion edges included in the first portion to partially achieve the desired edge effect for the bound document. The first portion of the plurality of sheets is greater than one sheet of the plurality of sheets. The first fold angle and the first fold direction are configured to achieve a desired fore edge effect.

33 Claims, 9 Drawing Sheets

SYSTEM AND METHOD OF TRIMMING A BOUND DOCUMENT

BACKGROUND

Electronic publishing of documents often demands more than a stack of paper in an output tray of an office printer. Typically, a plurality of duplex printed sheets are bound into finished documents by a publishing system that prints and finishes books. Currently, publishing systems perform operations such as collating, binding, folding, trimming, saddle stapling, hole drilling, etc. Such finishing operations are typically performed on all of the sheets in a book at one time, which generally requires use of high forces, powerful motors, and dangerous cutting devices. Consequently, the systems adapted to perform these functions are relatively expensive and often exceed the costs of other desktop or office printers. As such, known publishing systems are not generally well suited for use in low-cost desktop book making.

In particular, the plurality of sheets bound in a book are typically trimmed along a fore edge opposite the book spine or binding to achieve a finished and flush edge to the book. The flush edge is believed to provide a book that is relatively easy to flip through and manipulate as well as to provide a more aesthetically pleasing book. However, as discussed above, trimming is generally performed on all of the sheets in a book at one time, which increases the power, force, and general costs required for the publishing system.

In some instances, these requirements have been lessened by utilizing a sheetwise trimming device configured to individually trim each sheet within the book. Although such a method may decrease the force and power requirements, these methods often require additional computations to be made by the system which increase the time needed to trim the sheets of the book. Accordingly, there is a need for electronic desktop publishing machines that are compact, low cost, timely, and suitable for use with office printers and for methods associated therewith.

SUMMARY

One aspect of the present invention provides a method of trimming a plurality of sheets bound together and configured to be folded in an inward direction to define a closed bound document. Each of the plurality of sheets defines a first edge and a second edge opposite the first edge, and the plurality of first and second edges collectively define a fore edge of the closed bound document. The method comprises selecting a first portion of the plurality of sheets, folding the first portion of the plurality of sheets at a first fold angle and in a first fold direction, and trimming the folded first portion of the plurality of sheets near the first portion edges included in the first portion to partially achieve the desired edge effect for the bound document. The first portion of the plurality of sheets is greater than one sheet of the plurality of sheets. The first fold angle and the first fold direction are configured to achieve a desired fore edge effect.

BRIEF DESCRIPTION OF THE DRAWINGS

Embodiments of the invention are better understood with reference to the following drawings. Elements of the drawings are not necessarily to scale relative to each other. Like reference numerals designate corresponding similar parts.

DETAILED DESCRIPTION

In the following detailed description, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. Therefore, the following detailed description is not to be taken in a limiting sense, and the scope of the present invention is defined by the appended claims.

Figure 1A:
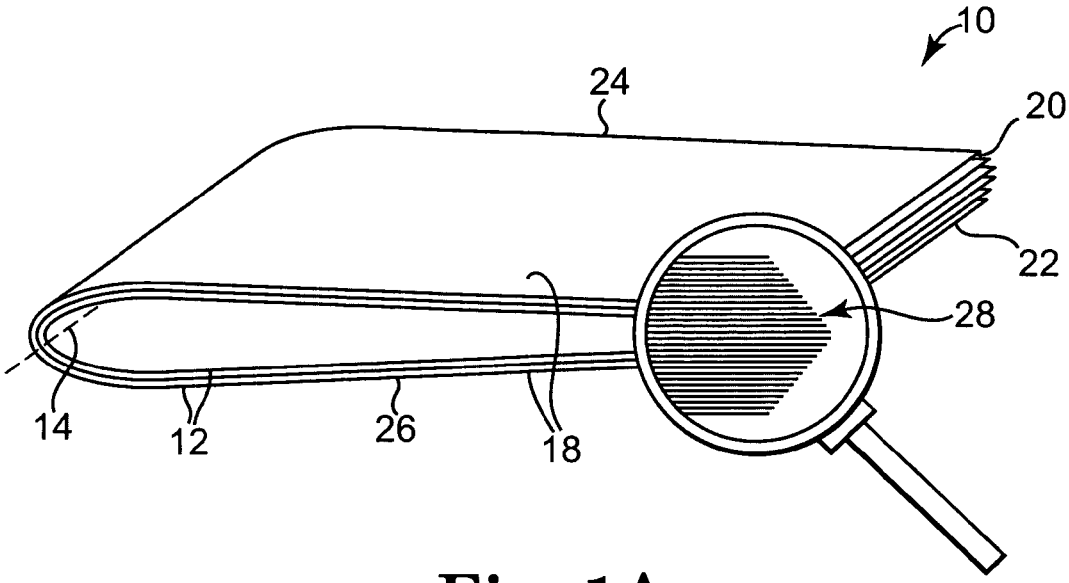
FIG. 1A is a perspective view of a bound document with an enlarged portion showing untrimmed edges.

FIG. 1A illustrates one embodiment of a book or bound document 10, such as a saddle-stitched booklet or other book prior to being trimmed. Book 10 is formed from a plurality of sheets 12 of equal dimension that are stacked and stapled or otherwise bound together. In particular, the plurality of sheets 12 are bound together along a line or spine 14, which extends across sheets 12, with a line of staples or other suitable binding method. In one embodiment, the plurality of sheets 12 are bound about a centerline of sheets 12. Book 10 is foldable inward about spine 14 to form a closed book 10 having a plurality of pages 18, wherein each sheet 12 defines two or more pages 18. More particularly, each sheet 12 defines four pages where each sheet is duplex printed. Each sheet 12 defines a first edge 20 and a second edge 22 opposite first edge 20. In one example, first edge 20, second edge 22, and spine 14 each extend substantially parallel to and spaced from one another. The plurality of folded sheets 12 collectively define a closed book 10 with a top edge or head 24, a bottom edge or foot 26, and a fore edge 28 extending between head 24 and foot 26 opposite spine 14. More specifically, fore edge 28 is collectively defined by the plurality of first edges 20 and the plurality of second edges 22 of folded sheets 12.

Because outer sheets 12 wrap around inner sheets 12 when book 10 is closed, simply assembling sheets 12 and folding produces a chamfered or beveled collective fore edge 28 as illustrated in the enlarged portion of FIG. 1A. As such, inner sheets 12 appear to extend further from spine 14 than more outer sheets 12 (and cover, if any) appear to extend from the spine 14, thereby forming fore edge 28 with a pointed profile. The formation of the pointed profile in fore edge 28 is generally referred to as edge creep.

Figure 1B:
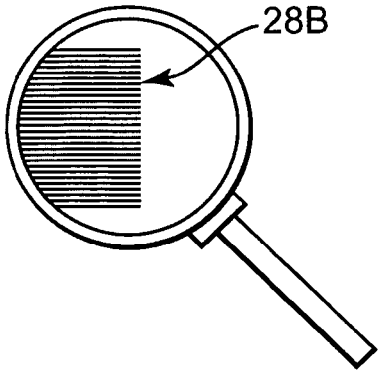
FIG. 1B is an enlarged portion of the bound document of FIG. 1A with trimmed edges.

Traditionally, when book 10 is closed, all sheets 12 in book 10 are trimmed twice (i.e., each sheet 12 is trimmed near each first edge 20 and near each second edge 22) and in a substantially simultaneous manner along a line inboard of edges 20 and 22 of the outer sheets 12 or cover (if any) to produce an even or flush collective fore edge 28B as illustrated in the FIG. 1B. However, systems and methods of trimming book 10 described herein present an alternative way of defining a trimmed fore edge 28B generally characterized by lower force motors, lower trimming forces, and a less dangerous and expensive overall trimming method as compared to traditional methods. In one example, fore edge 28 is trimmed to define a flush fore edge 28B of closed book 10. A flush fore edge 28B is generally considered more aesthetically pleasing, easier to flip through, and/or otherwise manipulate by a bearer of book 10 than an untrimmed fore edge 28.

Figure 2A:
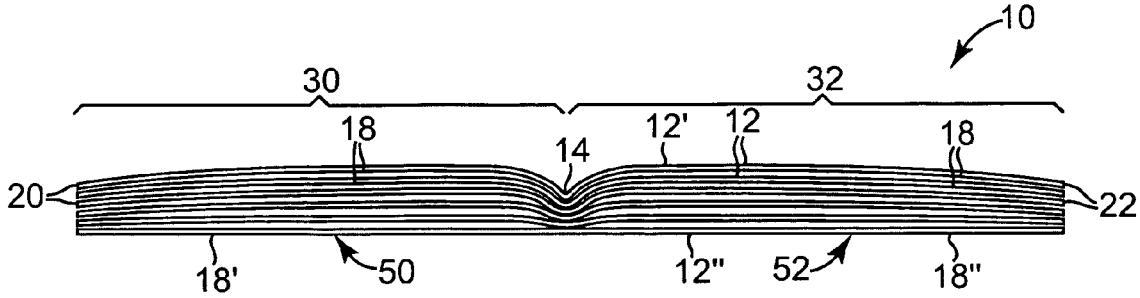
FIG. 2A is a side view of an open, untrimmed bound document.

During assembly of book 10, sheets 12 are stacked and stapled or otherwise bound while in an open or relatively flat configuration as illustrated with respect to FIG. 2A. When in the open configuration, book 10 defines a first side 30 and a second side 32, wherein first side 30 is separated from second side 32 by spine 14. As such, each of the plurality of sheets 12 defines first side pages 18' and second side pages 18". With this in mind, first side pages 18' define first edges 20, and second side pages 18" define second edges 22.

In FIGS. 2A-3B, 5A, and 6A, the compression of sheets 12 at spine 14 is exaggerated for illustrative purposes, and the plurality of sheets 12 each have generally equal dimensions prior to being trimmed. Due to the generally equal dimensions of sheets 12, when book 10 is open, each of the plurality of first edges 20 is spaced a similar distance from spine 14 and, therefore, collectively present a substantially flush or planar profile when untrimmed. Similarly, second edges 22 collectively present a substantially flush or planar profile when book 10 is open. However, when book 10 is folded inward about spine 14 to a closed position, the substantially flush or planar profiles defined by first and second edges 20 and 22 transition to collectively define the untrimmed, pointed profile fore edge 28 illustrated in FIG. 1A.

In one embodiment, sheets 12 are divided into and trimmed as a plurality of portions such that when all portions are trimmed, they collectively define a trimmed fore edge 28 with a desired fore edge effect, such as a flush edge, a tabbed edge, or other edge effect. Each of the plurality of portions includes at least two sheets 12. In one embodiment, each portion only includes one edge 20 or 22 of each of the plurality of sheets 12 included in the selected portion. In one example, book 10 is trimmed while in a generally open configuration to decrease the overall space needed to trim book 10.

Figure 2B:
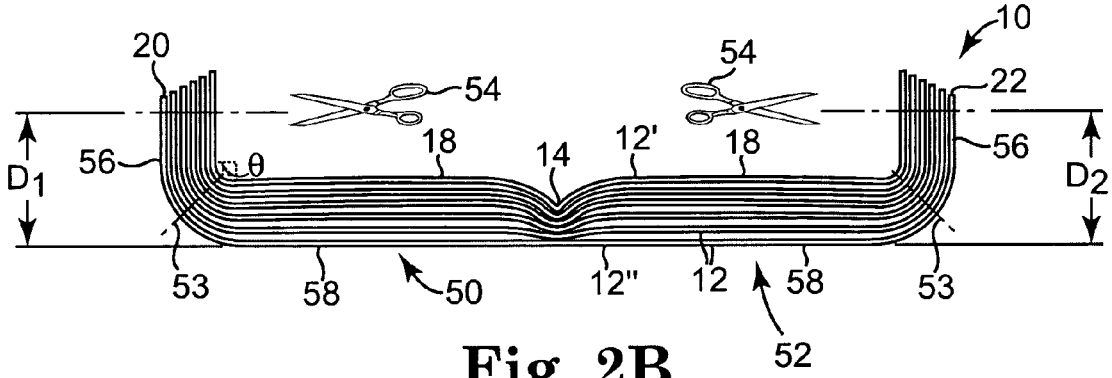
FIG. 2B is a schematic side view of the open bound document of FIG. 2A configured for trimming.
Figure 2C:
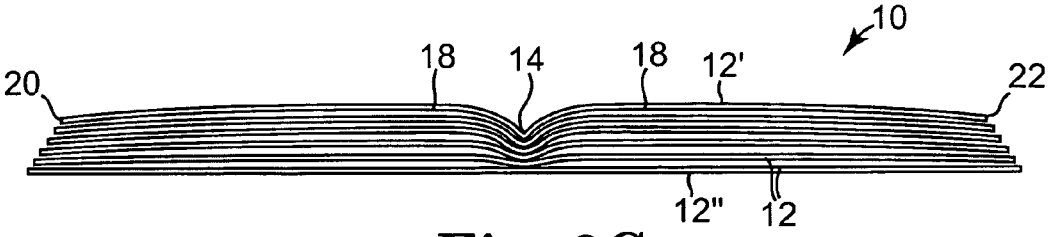
FIG. 2C is a schematic view of an open bound document of FIG. 2A with trimmed edges.

For example, in the embodiment of FIGS. 2A-2C, book sheets 12 are divided into two portions, namely, a first portion 50, which includes all of the first side pages 18', and a second portion 52, which includes all of the second side pages 18". Other numbers and sizes of portions for trimming fore edge 28 are also acceptable. In one embodiment, the number of portions selected is at least partially based on the sheet capacity (i.e., the number of pages a cutting blade can cut in a single pass) of the cutting apparatus(es) used to trim book 10.

Figure 4:
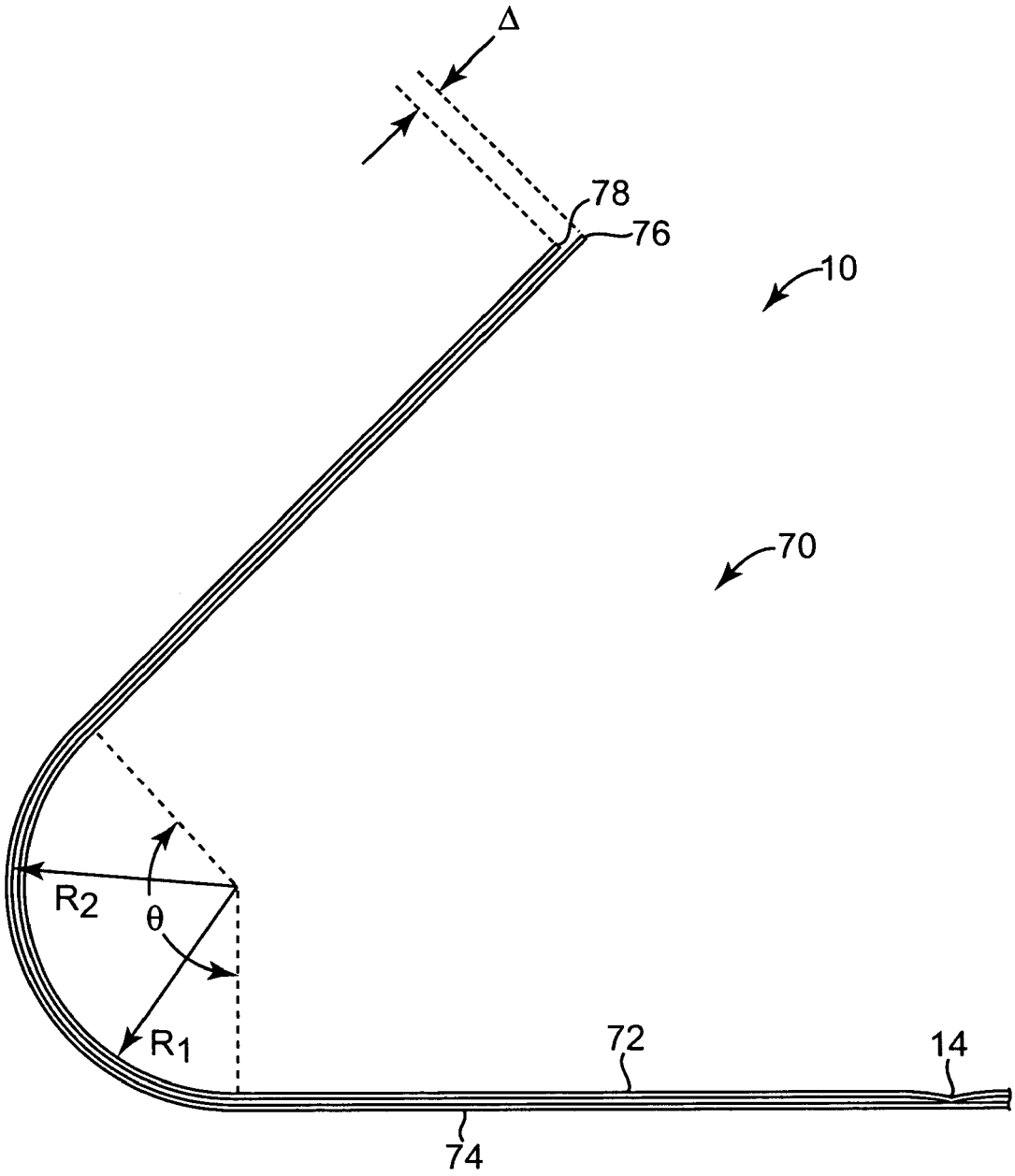
FIG. 4 is a schematic view of a portion of a bound document being folded for trimming.

Referring to FIG. 2B, first portion 50 is folded for trimming relatively near first edges 20 as compared to spine 14. First portion 50 is folded about a fold line 53 in one of an inward direction or an outward direction. More specifically, the inward direction is a direction toward an innermost sheet 12' of book 10 and is similar to the direction sheets 12 are folded to close book 10 (i.e. is up in FIG. 2B). The outward direction is a direction away from the innermost sheets 12 of book 10 (i.e. down in FIG. 2B) toward an outermost sheet 12" of book 10. First portion 50 is folded so as to generally avoid or lessen formation of a crease at or near fold line 53. For example, first portion 50 is folded at a radius having a sufficiently large value to decrease or prevent creasing of any of first side pages 18'. First portion 50 is also folded at a fold angle θ selected to achieve a desired trim or fore edge effect. Fold angle θ is defined as the angle of the arc formed by folded portion 50, which is more clearly illustrated with reference to FIG. 4. For example, as illustrated in FIG. 2B, first portion 50 is folded inward with a fold angle θ of approximately 90°. Once folded, a cutting apparatus or blade, generally indicated at 54, is utilized to cut through folded outer lengths 56 of first portion 50 (i.e. the length extending between fold line 53 and first edges 20) at a position relatively near first edges 20. More particularly, the cut is directed substantially perpendicular to the extension of outer lengths 56 to trim edges 20 of first portion 50.

Since book 10 is made to have a closed angle between first side pages 18' and second side pages 18" of approximately 180°, cutting each of portions 50 and 52, each folded at an inward fold angle of 90°, generally achieves the same cut amount as a cut across all sheets 12 in a closed book 10. When fold angle θ is substantially equal to 90°, outer length 56 of first portion 50 generally extends perpendicular to an inner length 58 (i.e. a length extending between spine 14 and fold line 53) of the pages 18 of first portion 50.

In one embodiment, cutting apparatus 54 is a scissors, blade, or other suitable cutting apparatus configured to cut a number of pages in a single pass. In one embodiment, cutting apparatus 54 is a rotary blade opposite a linear blade, which are configured cut pages 18 between them as the rotary blade advances over the linear blade. In this embodiment, where all first side pages 18' in first portion 50 are cut at one time, cutting apparatus 54 has a sheet capacity to cut through the entire first portion 50 of sheets 12 in a single pass. Similarly, cutting apparatus 54 has a sheet capacity sufficient to cut through the entire second portion 52 of sheets 12 in a single pass.

Second portion 52 is similarly folded and cut or trimmed with a similar or the same cutting apparatus 54. In this manner, cutting apparatus 54 is not generally required to have an edge sharp enough or applied with enough force to cut through all of the plurality of sheets 12 of a closed book 10 in a single pass. As such, a generally more inexpensive, less sharp, less cumbersome, and safer overall trimming system and method is utilized. In one embodiment, a distance $D_1$ between a cut line through first portion 50 and outermost sheet 12" of book 10 is equal to a distance $D_2$ between a cut line through second portion 52 and outermost sheet 12" of book 10.

After cutting, first and second portions 50 and 52 are released to once again lie in the flat or open position illustrated in FIG. 2C. Trimmed first edges 20 collectively define a linear profile that is angled inward toward spine 14. In this manner, when book 10 is open, each sheet 12 of book 10 generally extends a longer distance from spine 14 than an adjacent sheet 12 that is nearer innermost sheet 12', if any. Similarly, trimmed second edges 22 define a similar but symmetrical, linear profile angle inward toward spine 14. As such, when book 10 is closed, book 10 generally presents a flush collective edge 28B as illustrated in FIG. 1B.

In one embodiment, the number of sheets 12 that can be cut at a single time is limited by the sheet capacity of the particular cutting apparatus 54 being utilized to trim book 10. For example, cutting apparatus 54 may not be sufficiently sharp or may not be supplied with a sufficient force to cut an entire side 30 or 32 of sheets 12 at a single time. In such an embodiment, the plurality of sheets 12 may be divided into a larger number of portions for trimming, where each portion includes less than all of sheets 12 in each side 30 or 32. In one embodiment, the number of portions to be trimmed is determined based upon the sheet capacity of cutting apparatus 54.

Figure 3A:
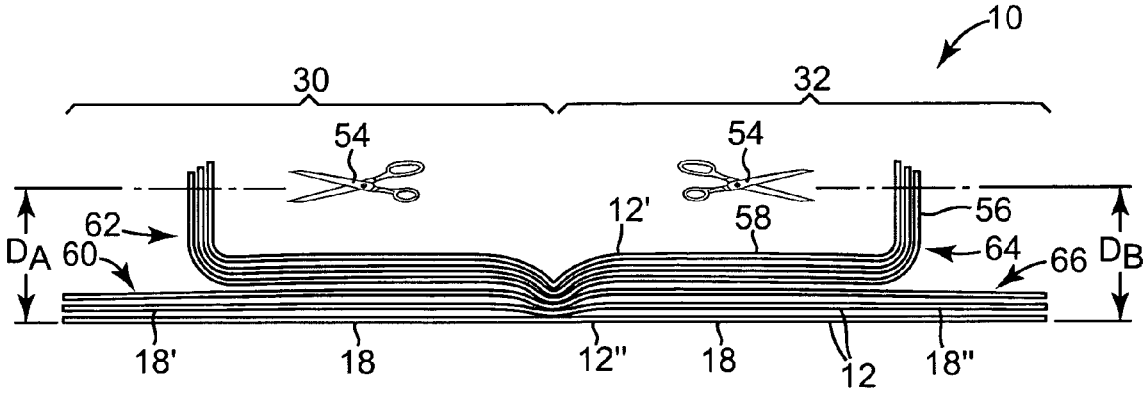
FIG. 3A illustrates a schematic view of an open bound document having portions positioned for trimming.
Figure 3B:
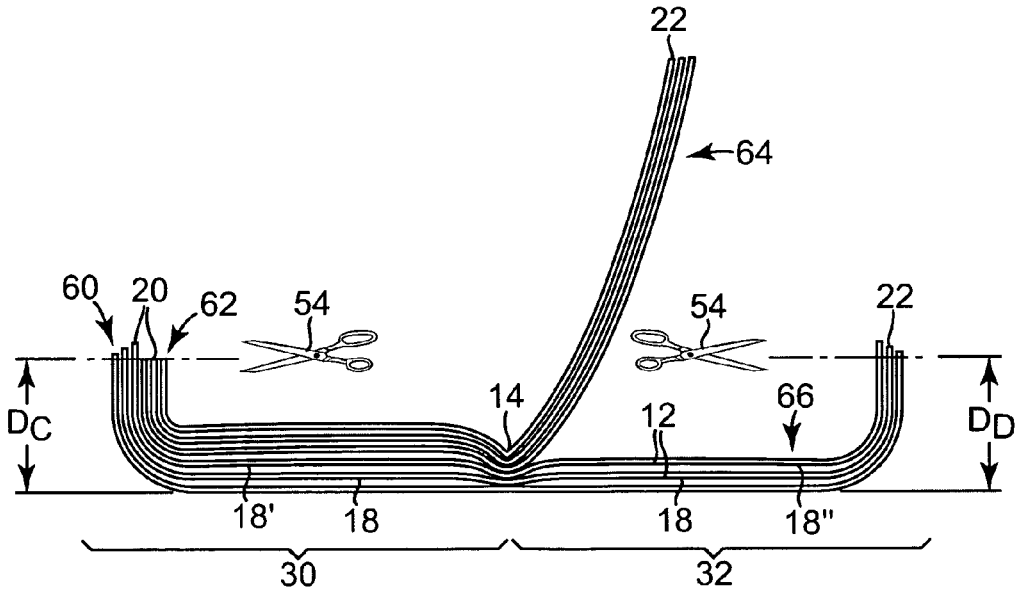
FIG. 3B is a schematic view illustrating the open bound document of FIG. 3A positioned to have additional portions trimmed.

In the example illustrated in FIGS. 3A and 3B, a book 10 is divided into more than two portions for trimming. More specifically, sheets 12 of book 10 are divided into four portions for cutting, namely a first portion 60, a second portion 62, a third portion 64, and a fourth portion 66. More specifically, first portion 60 and second portion 62 are formed from first side 30 of book 10, and third portion 64 and fourth portion 66 are formed from second side 32 of book 10. Second portion 62 is positioned inward from first portion 60, and third portion 64 is positioned inward from fourth portion 66. Inward portions 62 and 64 of book 10 are folded for trimming in a similar manner as described with respect to portions 50 and 52 of FIG. 2B. The folded inward portions 62 and 64 are each trimmed near the page edges 20 and 22, respectively, with a cutting apparatus 54 similar to that described with respect to FIG. 2B.

Following trimming of the inner most portions 62 and 64 of book 10, the outer most portions 60 and 66 of book 10 are also folded for trimming. In one example, as illustrated on the left side of FIG. 3B, trimmed second portion 62 remains folded while first portion 60 is folded to correspond with second portion 62. Cutting apparatus 54 trims first portion 60 to align with trimmed second portion 62. Since second portion 62 is already cut to be in line with the cutting apparatus path, the second pass across first side 30 results in trimming first portion 60. In other examples, such as that illustrated on the right side of FIG. 3B, trimmed inward portions, such as trimmed third portion 64, are lifted away from the cutting area while the untrimmed outer portion, such as untrimmed fourth portion 66, is folded and trimmed according to the methods described above. Once again, in this example cutting apparatus 54 generally trims a single portion 64 or 66 on each pass across second side 32. In one embodiment, each distance $D_A$, $D_B$, $D_C$, and $D_D$, which is defined between a cut line through a respective portion 62, 64, 60, and 66 and outermost sheet 12" of book 10, are substantially equal to one another.

In either example, the end product is an open book having linearly aligned and collectively angled edges 20 and 22 similar to that illustrated in FIG. 2C, which produce a flush fore edge 28B as illustrated in FIG. 1B when book 10 is closed.

Different fold angles may be used to produce different trim effects other than a flush fore edge 28B, such as a tabbed or flagged fore edge, a receding fore edge, etc. For example, as illustrated with additional reference to FIG. 4, a portion 70 is illustrated for simplicity purposes to include a first sheet 72 and a second sheet 74. Portion 70 is folded with a fold angle θ, and first sheet 72 and second sheet 74 are each folded with a radius of $R_1$ and $R_2$, respectively. As such, a sheet edge offset Δ is formed as the distance between a first edge 76 of first sheet 72 and a second edge 78 of second sheet 74. Since the position of spine 14 is substantially fixed for first sheet 72 relative second sheet 74, a length between spine 14 and an arc formed by folding sheet 72 is substantially equal to a length between spine 14 and an arc formed by folding sheet 74. Similarly, the edges of sheets 72 and 74 each extend from the respective arc a substantially equal distance. As such, the sheet edge offset Δ is generally a function of the arcs formed by the fold in sheets 72 and 74. More specifically:

$$\Delta = S_2 - S_1 \quad \text{(Equation I)}$$

where Δ=sheet edge offset $S_1$ =an arc length formed by folding first sheet 72, and $S_2$ =an arc length formed by folding second sheet 74.

Further, it is generally well known that:

$$S_i = R_i \times \theta \quad \text{(Equation II)}$$

where $S_i$=an arc length;

$R_i$=a radius forming arc length $S_i$; and

θ=a fold angle corresponding to arc length $S_i$.

Therefore, since the radius of the fold of second sheet 74 is generally equal to the radius of the fold of first sheet 72 plus the thickness of second sheet 74 (i.e., $R_2 = R_1 + t$), then:

$$S_1 = R_1 \times \theta \quad \text{(Equation III); and}$$

$$S_2 = (R_1 + t) \times \theta \quad \text{(Equation IV)}$$

Substituting the values of Equations III and IV into Equation I provides:

$$\Delta = t \times \theta \quad \text{(Equation V)}$$

As such, the radii $R_1$ and $R_2$ at which sheets 72 and 74 are folded is of little consequence to the resulting sheet edge offset Δ. Therefore, in one example, radii $R_1$ and $R_2$ are primarily selected as a function of available space and with a desired curvature to prevent or at least decrease creasing of sheets 72 and 74 while folded.

Equation V demonstrates that as fold angle θ increases, sheet edge offset Δ generally increases and as fold angle θ decreases, sheet edge offset Δ generally decreases. In fact, a negative fold angle θ (i.e., a fold angle in an outward direction) will generally produce a negative sheet edge offset Δ, which will alter the fore edge effect as will become more apparent below. In particular, the larger sheet edge offset Δ, the larger creep correction will be made when portion 70 is trimmed since the trim line is generally perpendicular to the extension of portion 70 near edges 20. With this in mind and in view of the discussion of FIGS. 2A-2C, in general, a fold angle θ between about 0° and about 90° in an inward direction incrementally decreases creep, a fold angle θ greater than about 90° and less than or equal to about 180° in an inward direction reverses and incrementally increases creep, and a fold angle θ between about 0° and about 180° in an outward direction (i.e. between about 0° and about negative 180°) increases creep. Accordingly, fold angle θ of each portion is altered to effectuate the desired creep correction, which will collectively produce the desired fore edge effect.

Figure 5A:
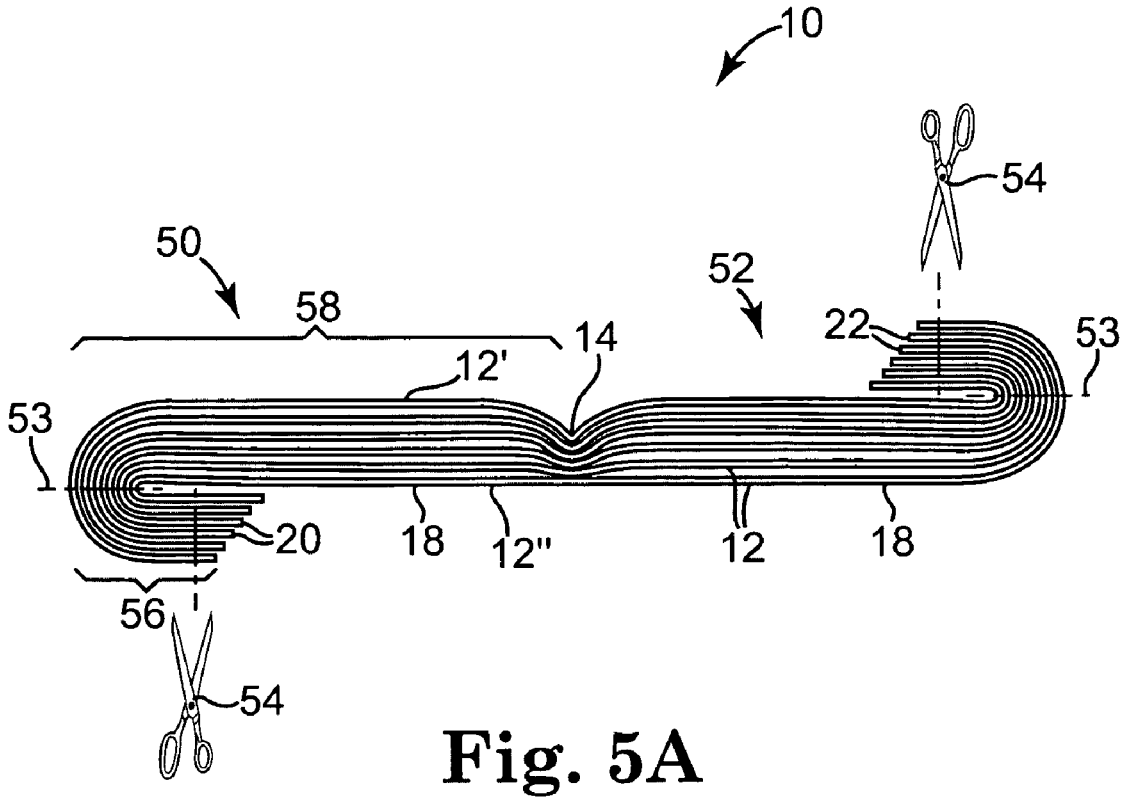
FIG. 5A is a schematic view illustrating an open bound document having edges positioned for trimming.

In particular, as illustrated with respect to FIG. 5A, sheets 12 of book 10 are divided into a first portion 50 and second portion 52 where each portion is equal to a full side of sheets of book 10. However, in this embodiment, first portion 50 is folded with a fold angle of approximately negative 180° (i.e., with a fold angle of 180° in an outward direction). With this in mind, outer length 56 of first portion 50 is folded to extend generally parallel to inner length 58 of first portion 50 extending between fold line 53 and spine 14. As such, cutting apparatus 54 is used to cut through outer length 56 of first portion 80 relatively near to sheet edges 20 in a manner substantially perpendicular to the extension of outer length 56 of first portion 50. As such, each sheet of first portion 50 is trimmed to extend from spine 14 a longer distance than an adjacent more outer sheet 12 (i.e. a sheet 12 nearer outermost sheet 12"), if any, of first portion 50. In this manner the edge creep of first portion 50 is increased.

Second portion 52 of FIG. 5A, conversely is folded inwardly with a fold angle of approximately 180° (i.e., with a fold angle of 180° and in an inward fold direction). When folded, each sheet of second portion 52 is trimmed with a cut line substantially perpendicular to the extension of outer length 56 of second portion 52 being trimmed. As such, each page of second portion 52 is trimmed to extend from spine 14 a shorter distance than an adjacent more outer sheet 12 (i.e. a sheet 12 nearer outermost sheet 12"), if any, of first portion 50. In this manner, edge creep is reversed and increased for portion 52.

Figure 5B:
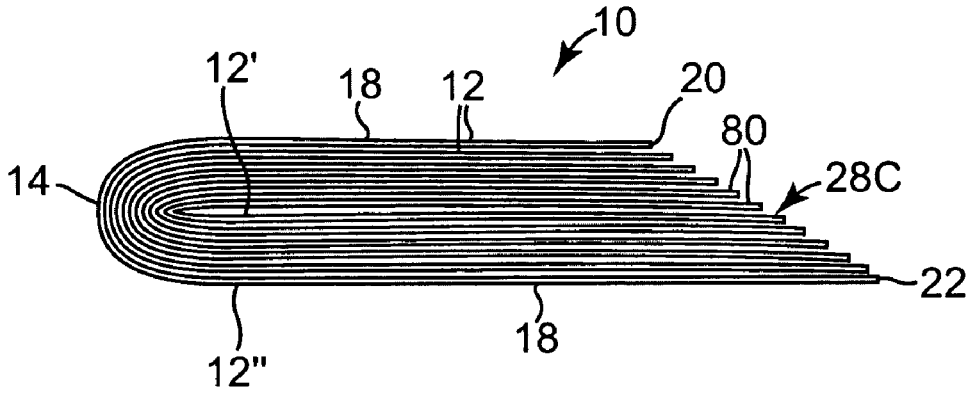
FIG. 5B is a schematic view illustrating a closed bound document trimmed according to FIG. 5A.

When book 10 is closed as illustrated in FIG. 5B, a fore edge 28C is collectively defined to angle between edges 20 and 22 of the outermost sheet 12, such as from the front of book 10 to the back of book 10. In one example, such a flagged or tabbed fore edge effect creates exposed planar portions 80 near each respective edge 20 and 22 of sheets 12. Each exposed planar portion 80 can be used as an index tab or other feature of book 10. In one embodiment, each sheet 12 or each page 18 of book 10 is colored differently than adjacent sheets 12 or pages 18 to further emphasis the exposed planar portions 80.

Although only a few fore edge effects are illustrated and described herein, it will be apparent to one of skill in the art to use the principles discussed herein to create various functional and/or cosmetic edge effects by trimming the sheets of a book in a plurality of portions, wherein each portion includes more than one sheet of the book. In one example, in which more than two portions are selected, each portion may be trimmed in a similar or different manner than the other portions of the book.

Figure 6A:
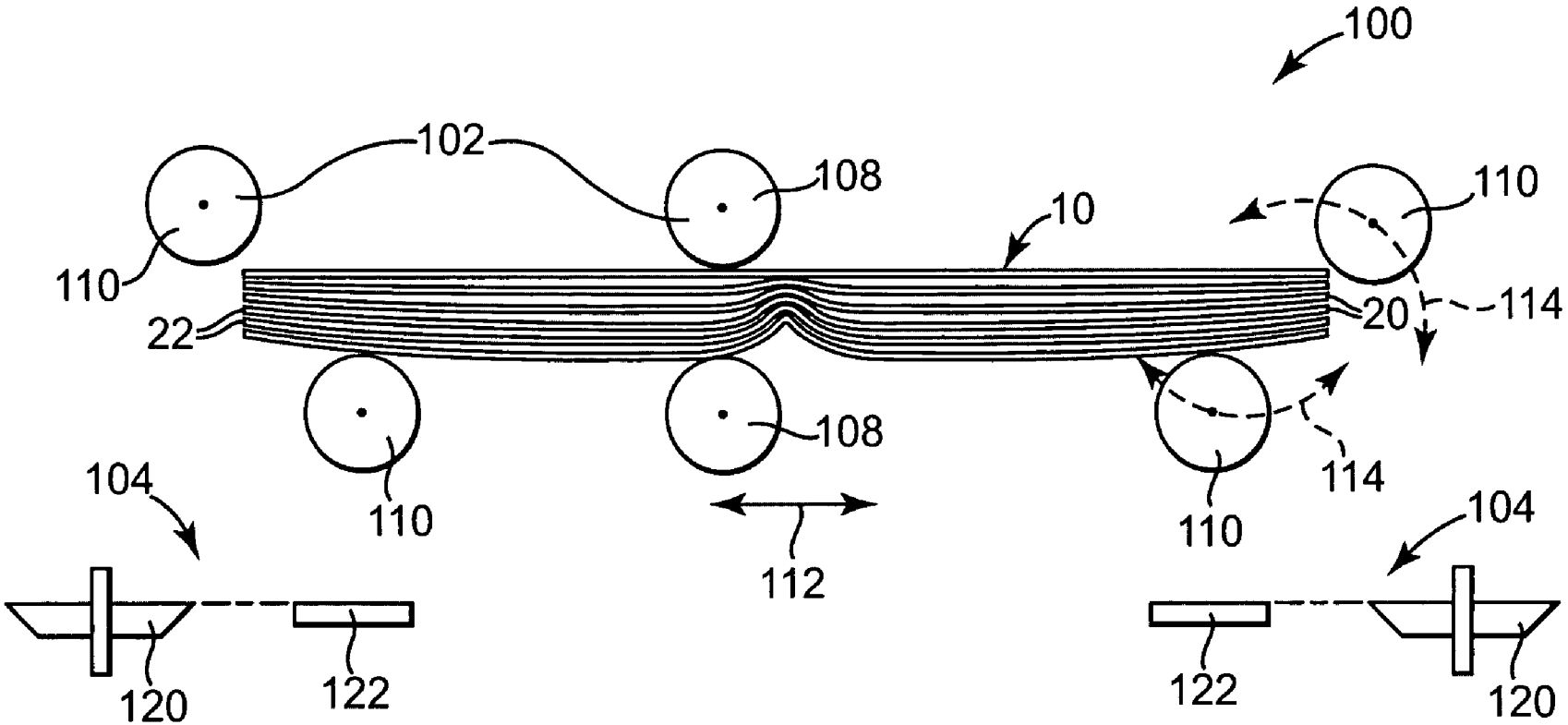
FIG. 6A is a schematic side view of a trimming system with a bound document according to the present invention.

FIG. 6A generally illustrates one embodiment of a trimming system 100 for trimming book 10 or other bound document. Trimming system 100 includes a plurality of rollers 102 for manipulating the position of book 10 and one or more cutting apparatuses 104 for trimming sheets 12 of book 10. In one example, two cutting apparatuses 104 are included where one cutting apparatus 104 is configured to cut one side of book 10 and the other cutting apparatus 104 is configured to cut the other side of book 10. Each cutting apparatus 104 is suitably spaced from the other cutting apparatus 104.

In one example, the plurality of rollers 102 includes movement or translating rollers 108 and folding rollers 110. Translating rollers 108 are configured to received open or unfolded book 10 and to substantially linearly move open book 10 side to side as generally indicated by the arrow 112. A pair of folding rollers 110 are positioned on either side of unfolded book and are configured to selectively manipulate portions of book 10 for trimming.

In particular, book 10 is fed into trimming system 100, more specifically, is positioned between translating rollers 108. Translating rollers 108 rotate to move book 10 towards one of the pairs of folding rollers 110. As an edge of book 10 is moved, it eventually contacts the respective pair of folding rollers 110, which force the edge of book 10 to fold in a desired direction and with a desired fold angle as indicated with additional reference to the more detailed view of FIG. 6B. In one example, folding rollers 110 generally move as indicated by arrows 114 in addition to rotating to manipulate book 10 towards one of cutting apparatuses 104 at a desired fold angle and in a desired fold direction. In one example, each cutting apparatus 104 is movable to cut edges of book 10 at the proper angle and/or with the proper orientation to achieve a desired fore edge effect.

Figure 6B:
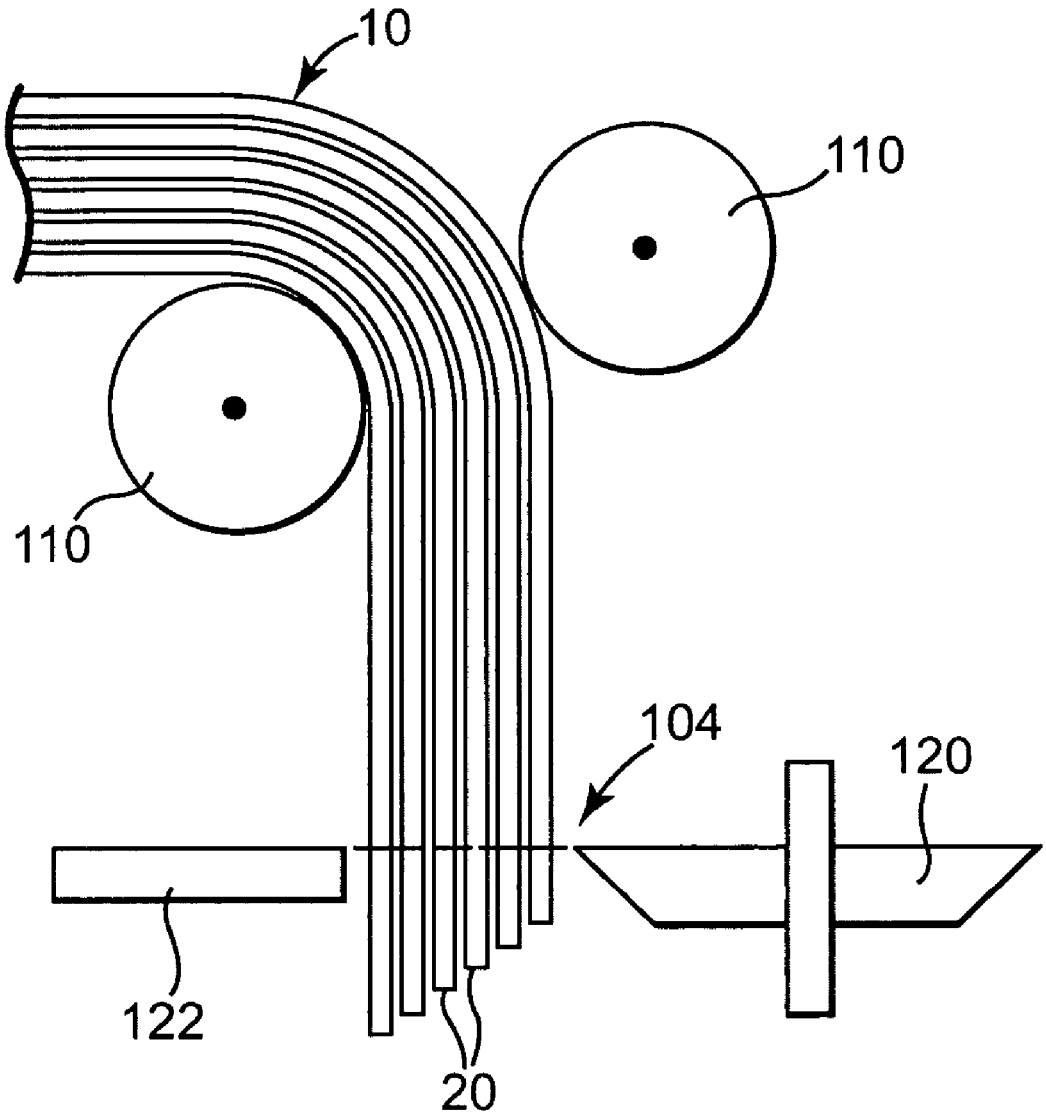
FIG. 6B is an enlarged schematic side view of a portion of the trimming unit and the bound document of FIG. 6A.

In the example illustrated in FIGS. 6A and 6B, folding rollers 110 collectively fold a selected portion, which in this case is an entire side, of book 10 inward at a 90° fold angle to be cut by cutting apparatus 104. As illustrated, cutting apparatus 104 includes a rotary cutting blade 120 and a linear blade 122. The folded portion of book 10 is fed between blades 120 and 122. Blades 120 and 122 are pressed against one another and rotary blade 120 rotates over linear blade 122 in a direction parallel to the respective edge of book 10. As such, the selected portion is trimmed. Following trimming of the selected portion, rollers 108 are reversed to move book 10 away from a first cutting apparatus 104 and toward a second cutting apparatus 104 to trim the remaining portion of book 10. In one example, book 10 is alternatively moved between cutting apparatuses 104 to trim multiple portions of book 10.

Other trimming systems utilize other mechanisms to move, fold, and trim each individual portion of book 10. For instance, trimming systems may include only one pair of folding rollers 110 and/or only one trimming apparatus 104, which are each utilized to fold and trim both sides of book 10. Once each portion of book 10 is trimmed, unfolded book 10 is output to an output tray or to another book finishing station within the book publishing system. In addition, in one embodiment, additional rollers or other pick mechanisms are included in trimming system 100 that are configured to isolate individual portions of book 10, each portion having less than all of the plurality of sheets 12 of book 10, for folding and/or trimming. In one embodiment, trimming system 100 is controlled by a computer system or processor configured to execute the trimming method per instructions read from a computer-readable medium.

Figure 7:
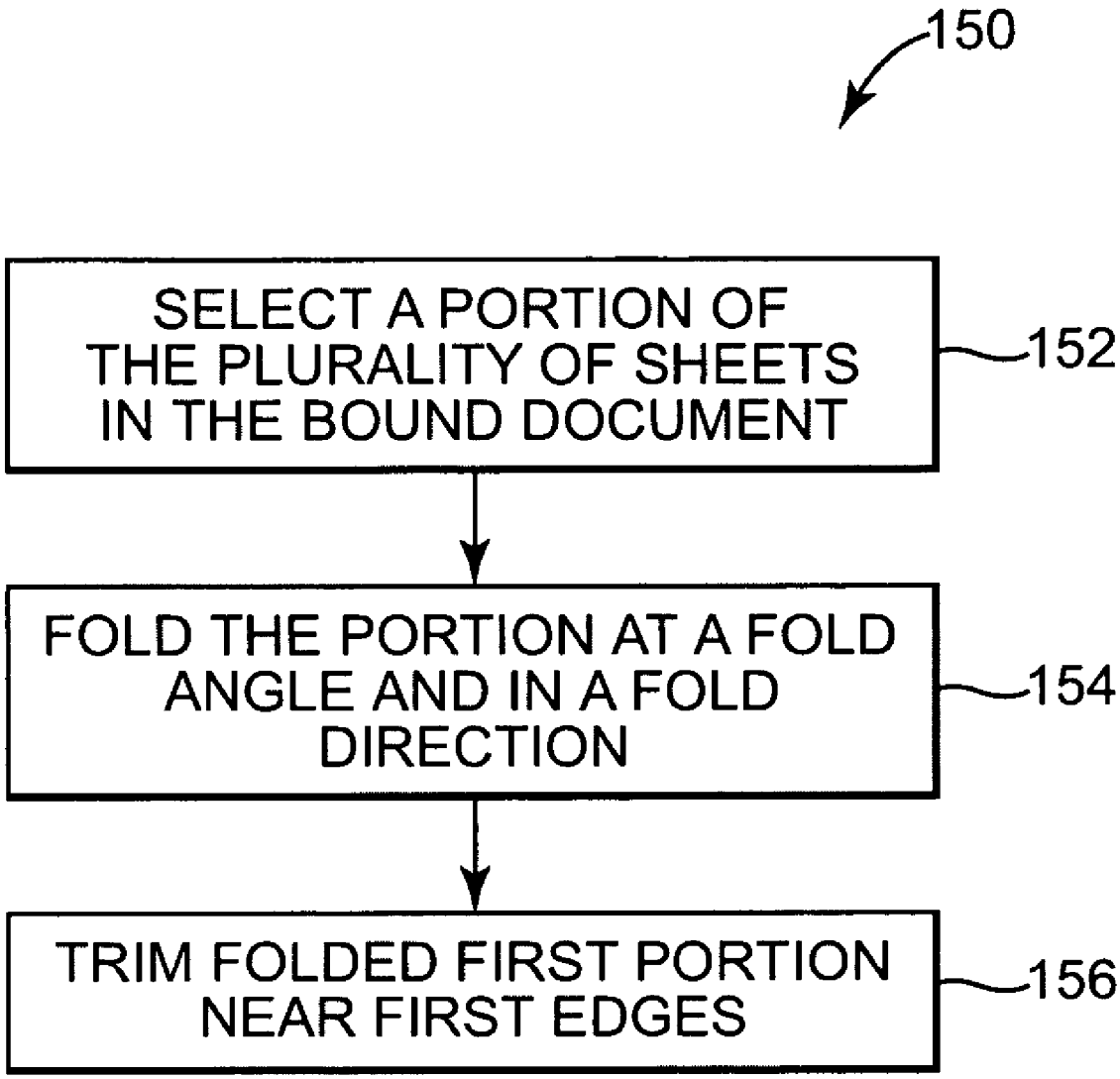
FIG. 7 is a flow chart generally illustrating a method of trimming a bound document.

FIG. 7 illustrates one embodiment of a method of trimming a book 10 at 150. At 152, a portion of the plurality of sheets in book 10 is selected to include more than one of the plurality of sheets. At 154, the portion is folded at a first fold angle and in a first fold direction. The first fold angle and the first fold direction are configured to achieve a desired fore edge effect. At 156, the folded portion of the plurality of sheets are trimmed near the first edges included in the first portion to partially achieve the desired fore edge effect.

Figure 8:
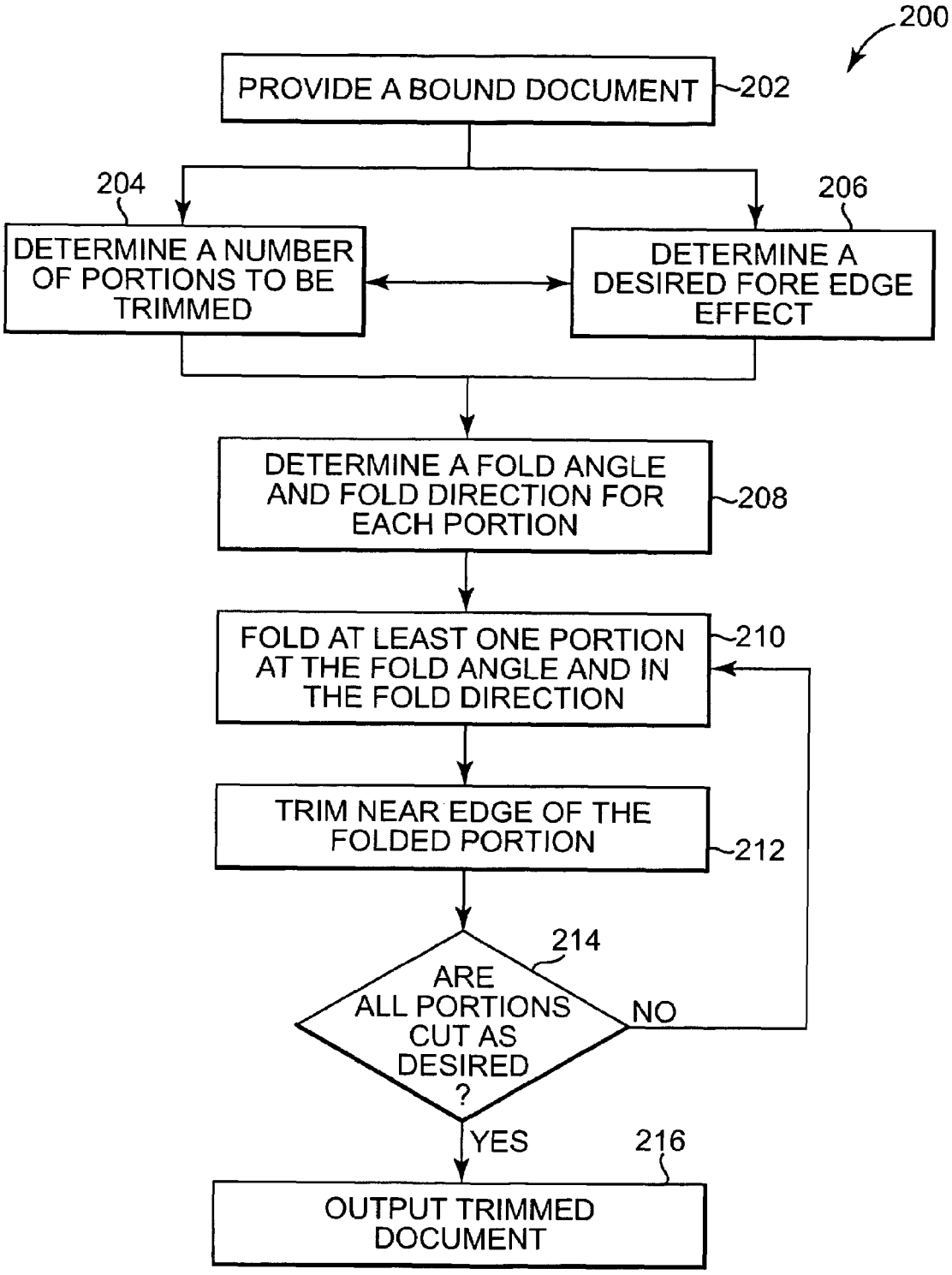
FIG. 8 is a flow chart generally illustrating a method of trimming a bound document.

A more particular embodiment of a method of trimming a book 10 or other bound document is generally illustrated in FIG. 8 at 200. At 202, a bound document or book is provided to a trimming system. At 204, a number of portions to be trimmed is determined. The number of portions may be based on one or more of a sheet capacity of the cutting apparatus, a force to be applied to the cutting apparatus, a desired fore edge effect, etc. At 206, a desired fore edge effect is selected for the book, such as a flush edge effect, a tabbed or flagged edge effect, etc.

At 208, a fold angle θ (illustrated in FIGS. 2B and 3) and a fold direction (i.e., inward or outward) is determined for each selected portion based upon the desired fore edge effect. At 210, a portion of the book is folded at the fold angle θ and in the fold direction determined at 208. For example, where a flush fore edge is desired, the portion is folded inward at a 90° fold angle as illustrated in FIG. 2B. At 212, the folded portion is cut near the sheet edges of the folded portion. Although described with respect to one portion, in one embodiment, two portions of the book, namely two portions on opposite sides of the book, are simultaneously folded and trimmed at 210 and 212.

At 214, it is determined whether all portions of the book have been trimmed as desired to achieve the desired fore edge effect. If yes, then at 216 the trimmed book is output to an output tray or to another finishing station of the document publishing system where the trimmed book exemplifies a desired fore edge effect. If no, than operations 210 and 212 are repeated as necessary until all desired portions of the book are trimmed to achieve the desired fore edge effect. One skilled in the art will recognize that various operations 204, 206, 208, 210, and 212 can be performed in various orders to determine and achieve a desired fore edge effect for the book. Use of other methods to trim the book is also contemplated.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A method of trimming a plurality of sheets bound together and configured to be folded in an inward direction to define a closed bound document, each of the plurality of sheets defines a first edge and a second edge opposite the first edge, and the plurality of first and second edges collectively define a fore edge of the closed bound document, the method comprising:

selecting a first portion of the plurality of sheets, wherein the first portion includes more than one of the plurality of sheets;

temporarily folding, without forming a crease, the first portion of the plurality of sheets at a first location, at a first fold angles, and in a first fold direction, wherein the first fold angle and the first fold direction are configured to achieve a desired fore edge effect; and trimming, while maintaining the temporary folding action, the first portion of the plurality of sheets at a second location near the first edges included in the first portion to partially achieve the desired fore edge effect, wherein the second location is spaced apart from the first location.

2. The method of claim 1, wherein the first portion includes all of the plurality of sheets.

3. The method of claim 1, wherein the desired fore edge effect is a fore edge having a substantially flush profile.

4. The method of claim 3, wherein temporarily folding the edges of the first portion of the plurality of sheets is performed where the first fold angle is substantially equal to 90° and the first fold direction is inward.

5. The method of claim 1, wherein the desired fore edge effect is a fore edge having increased and reversed creep relative to the fore edge prior to trimming, and further wherein the temporarily folding the first portion of the plurality sheets is performed where the first fold angle is substantially equal to 180° and the first fold direction is inward.

6. The method of claim 1, wherein the desired fore edge effect is a fore edge having increased creep relative to the fore edge prior to trimming, and further wherein temporarily folding the first portion of the plurality of sheets comprises locating a creaseless fold line at the second location between the first edge and a spine of the bound document, and wherein the first fold angle formed at the creaseless fold line is substantially equal to 180° and the first fold direction is outward.

7. The method of claim 1, further comprising:

selecting a second portion of the plurality of sheets, wherein the second portion includes more than one of the plurality of sheets;

temporarily folding the second portion of the plurality of sheets at a third location, at a second fold angle, and in a second fold direction without forming a crease, wherein the second fold angle and the second fold effect are configured to achieve the desired fore edge effect;

collectively trimming, while maintaining the temporary folding action, the second portion of the plurality of sheets at a fourth location near the second edges to partially achieve the desired fore edge effect, wherein the third location is spaced apart from the fourth location.

8. The method of claim 7, wherein the second portion includes all of the plurality of sheets.

9. The method of claim 7, wherein the first fold angle is substantially the same as the second fold angle, and the first fold direction is the same as the second fold direction.

10. The method of claim 7, wherein the desired fore edge effect includes a first portion edge effect achieved by trimming the first portion and a second portion edge effect achieved by trimming the second portion, and further wherein the first portion edge effect differs from the second portion edge effect.

11. The method of claim 7, wherein the first portion includes a first number of the plurality of sheets, and the second portion includes a second number of the plurality of sheets, wherein the first number is substantially equal to the second number.

12. The method of claim 1, wherein selecting a first portion of the plurality of sheets includes determining a number of the plurality of sheets to include in the first portion, wherein the number of the plurality of sheets included in the first portion is less than or equal to a sheet capacity of a cuffing apparatus used in trimming the first portion.

13. The method of claim 1, wherein the bound document is substantially open during the temporary folding and trimming of the first portion of the plurality of sheets.

14. A method of finishing a bound document including a plurality of sheets, the method comprising:

dividing the plurality of sheets into at least a first portion and a second portion, wherein each of the first portion and the second portion includes at least two of the plurality of sheets;

temporarily folding the first portion at first location, at a predetermined first fold angle, and in a predetermined first fold direction without forming a crease;

trimming, while maintaining the temporary folding of the first portion, the first portion at a second location to achieve a first portion edge effect, wherein the second location is spaced apart from the first location;

temporarily folding the second portion at third location, at a predetermined second fold angle, and in a predetermined second fold direction without forming a crease; and trimming, while maintaining the temporary folding action of the second portion, the second portion at a fourth location to achieve a second portion edge effect, wherein the third location is spaced apart from the fourth location;

wherein the first portion edge effect and the second portion edge effect collectively at least partially define an overall fore edge effect for the plurality of sheets.

15. The method of claim 14, wherein the first fold angle is substantially the same as the second fold angle, and the first fold direction is the same as the second fold direction.

16. The method of claim 14, wherein dividing the plurality of sheets includes defining the first portion of the plurality of sheets to include all of the plurality of sheets in the bound document.

17. The method of claim 14, wherein dividing the plurality of sheets includes dividing the plurality of sheets into a plurality of portions, wherein each of the portions includes less than all of the plurality of sheets.

18. The method of claim 14, wherein each of the first and second portions has a substantially equal number of sheets.

19. The method of claim 14, wherein dividing the plurality of sheets includes determining a number of the plurality of sheets to include in each of the first portion and the second portion, and further wherein the number of the plurality of sheets in each of the first portion and the second portion is less than or equal to a sheet capacity of a cutting apparatus provided to trim each folded first and second portion.

20. The method of claim 14, wherein the first portion edge effect differs from the second portion edge effect.

21. A trimming system configured to trim a bound document including a plurality of sheets divided into at least two portions including a first portion of more than one sheet and a second portion of more than one sheet, the trimming system comprising:

a folding mechanism configured to temporarily fold the first portion of the plurality of sheets at a first location, with a first fold angle, and in a first fold direction to form a creaseless fold line of the first portion between a first edge and a spine of the bound document; and a cutting apparatus positioned relative to the folding mechanism to enable cutting across the temporarily folded first portion, at a second location spaced apart from the first location, to create a first portion edge effect while the folding mechanism maintains the temporarily folded position of the first portion during the cutting.

22. The trimming system of claim 21, wherein the cutting apparatus includes a rotary blade and a linear blade configured to trim the first portion of the plurality of sheets between the rotary blade and the linear blade.

23. The trimming system of claim 21, wherein the folding mechanism is configured to temporarily fold the first portion of the plurality of sheets at the creaseless fold line at a range of fold angles between about 0° and about 180° in an inward fold direction.

24. The trimming system of claim 23, wherein the folding mechanism is configured to temporarily fold the first portion of the plurality of sheets, at the creaseless fold line, at a range of fold angles between about 0° and about 180° in an outward fold direction such that a first edge of the first portion is generally closer to an outermost sheet of the bound document than to an innermost sheet of the bound document.

25. The trimming system of claim 21, wherein the folding mechanism is configured to temporarily fold the first portion of the plurality of sheets, at the creaseless fold line, at a range of fold angles between about 0° and about 180° in an outward fold direction such that a first edge of the first portion is generally closer to an outermost sheet of the bound document than to an innermost sheet of the bound document.

26. The trimming system of claim 21, wherein the folding mechanism is configured to temporarily fold the first portion of the plurality of sheets at a creaseless fold line, wherein the first fold angle is substantially 90° and the first fold direction is inward such that a first edge of the first portion is generally closer to an innermost sheet of the bound document than to an outermost sheet of the bound document.

27. The trimming system of claim 21, wherein the folding mechanism is configured to temporarily fold the first portion of the plurality of sheets at the creaseless fold line to define an inner length of the first portion extending between the spine and the fold line and to define an outer length of the first portion extending between the fold line and a first edge of the first portion, wherein the first fold angle is substantially 180° and the first fold direction is inward to cause the outer length to extend generally parallel to the inner length such that the outer length is generally closer to an innermost sheet of the bound document than to an outermost sheet of the bound document.

28. The trimming system of claim 21, wherein the folding mechanism is configured to temporarily fold the first portion of the plurality of sheets at the creaseless fold line to define an inner length of the first portion extending between the spine and the fold line and to define an outer length of the first portion extending between the fold line and a first edge of the first portion, wherein the first fold angle is substantially 180° and the first fold direction is outward to cause the outer length to extend generally parallel to the inner length such that the outer length is closer to an outermost sheet of the bound document than to an innermost sheet of the bound document.

29. The trimming system of claim 21, wherein the cutting apparatus is a first cutting apparatus, and the trimming system further includes a second cutting apparatus.

30. The method of claim 5 wherein temporarily folding the first portion comprises:

arranging an inner length of the first portion to extend between the spine and the first fold line and arranging an outer length of the first portion to extend between the first fold line and the first edge, wherein temporarily folding the first portion includes orienting the outer length to extend in the inward first fold direction and generally parallel to the inner length with the outer length being closer to innermost sheets of the bound document than to outermost sheets of the bound document.

31. The method of claim 30, comprising:

orienting the first edge of the first portion to face toward the spine of the bound document.

32. The method of claim 6 wherein temporarily folding the first portion comprises:

arranging an inner length of the first portion to extend between the spine and the first fold line and arranging an outer length of the first portion to extend between the first fold line and the first edge, wherein folding the first portion includes orienting the outer length to extend in the outward first fold direction and generally parallel to the inner length with the outer length being closer to outermost sheets of the bound document than to innermost sheets of the bound document.

33. The method of claim 32, comprising:

orienting the first edge of the first portion to face toward the spine of the bound document.

* * * * *

UNITED STATES PATENT AND TRADEMARK OFFICE

CERTIFICATE OF CORRECTION

PATENT NO. : 7,641,433 B2
APPLICATION NO. : 11/287539
DATED : January 5, 2010
INVENTOR(S) : Steven W. Trovinger It is certified that error appears in the above-identified patent and that said Letters Patent is hereby corrected as shown below:

In column 9, line 30, in Claim 1, delete "angles," and insert -- angle, --, therefor.

In column 10, line 29, in Claim 12, delete "cuffing" and insert -- cutting --, therefor.

Signed and Sealed this

Fourth Day of May, 2010

David J. Kappos

David J. Kappos
*Director of the United States Patent and Trademark Office*